US005457925A

United States Patent [19]

Koedyker

[11] Patent Number: 5,457,925

[45] Date of Patent: Oct. 17, 1995

[54] ARTIFICIAL CEILING SYSTEM

[75] Inventor: James A. Koedyker, Tucson, Ariz.

[73] Assignee: The Larson Company, Tucson, Ariz.

[21] Appl. No.: 235,482

[22] Filed: Apr. 29, 1994

[51] Int. Cl.[6] ..... E04B 1/38

[52] U.S. Cl. ..... 52/506.06; 52/506.07; 52/220.6; 52/28; 248/343

[58] Field of Search ..... 248/343; 52/506.06, 52/506.07, 28, 698, 220.6, 506

[56] References Cited

U.S. PATENT DOCUMENTS

| | | | |
|---|---|---|---|
| 2,800,308 | 7/1957 | Parkinson et al. | 52/220.6 X |
| 3,241,280 | 3/1966 | Kreuzer | 52/506.06 |
| 3,385,020 | 5/1968 | Olson | 52/506.06 X |
| 3,612,461 | 10/1971 | Brown | 52/506.07 X |
| 3,785,095 | 1/1974 | Verner . | |
| 4,070,840 | 1/1978 | Moomey, Jr. . | |
| 4,424,656 | 1/1984 | LaVanture . | |
| 4,426,822 | 1/1984 | Gailey | 52/506.06 X |
| 4,525,971 | 7/1985 | Kern | 52/506.06 |
| 4,640,077 | 2/1987 | Hall | 52/506.06 X |
| 4,648,229 | 3/1987 | Limp . | |
| 4,671,811 | 6/1987 | Cadwell, Jr. et al. | 52/506.06 X |
| 4,742,662 | 5/1988 | Smith | 52/506.07 X |
| 4,773,200 | 9/1988 | Young | 52/506.06 |
| 4,841,709 | 6/1989 | Peterson | 52/506.06 X |
| 5,077,951 | 1/1992 | Baker . | |
| 5,325,647 | 7/1994 | Forry et al. | 52/506.07 X |

FOREIGN PATENT DOCUMENTS

| | | | |
|---|---|---|---|
| 27196 | 4/1981 | Germany | 52/506.07 |

*Primary Examiner*—Carl D. Friedman
*Assistant Examiner*—Beth A. Aubrey
*Attorney, Agent, or Firm*—Ogram & Teplitz

[57] ABSTRACT

An improved ceiling system to be assembled under an existing ceiling. The ceiling system is constructed of materials so as to simulate naturally occurring materials. The support members simulate such items as logs, wooden beams, and the like. Panels between the support member also simulate naturally occurring items like latillas and saguaro ribs. In the preferred embodiment, the support beams are constructed through a casting method and are composed of foam which is then painted to simulate the desired naturally occurring material. In the preferred embodiment of the panels, they are constructed of the same materials so that the resulting assemblage is not only extremely light and easy to install and transport, but, is also less expensive than naturally occurring materials which are becoming scarce.

26 Claims, 2 Drawing Sheets

ARTIFICIAL CEILING SYSTEM

BACKGROUND OF THE INVENTION

This invention relates generally to construction and more particularly to ceiling systems.

Long before the Vatican commissioned Michelangelo to paint the ceiling of the Sistine Chapel, ceilings have been used to add finish, and decoration to a room. Usually a ceiling with character though must be developed at the time of the rooms construction.

In modern buildings, a general purpose "shell" for the room is usually constructed. After construction, the user of the building adds the walls and ceiling as they so desire. In many instances, these ceilings are merely lowered paneled ceilings of sound absorbing material which hang by wires from the rough original ceiling. Little or no imagination seem to be expended.

A variety of inventions have been developed which assist in the construction of this ubiquitous ceiling arrangement. Examples of such ceilings are described in: U.S. Pat. No. 5,077,951, entitled "Suspended Ceiling System" issued to Baker on Jan. 7, 1992; U.S. Pat. No. 4,424,656, entitled "Assembly Clip for Ceiling Panels" issued to LaVanture on Jan. 10, 1984; U.S. Pat. No. 4,070,840, entitled "Suspended Ceiling Construction" issued to Moomey, Jr. on Jan. 31, 1978; U.S. Pat. No. 3,785,095, entitled "Multi-Unit Folding Slab Construction" issued to Verner on Jan. 15, 1974; and U.S. Pat. No. 4,648,229, entitled "Suspended Ceiling System Having Tiles with Interspersed Hooks Resting on Runners" issued to Limp on Mar. 10, 1987.

These ceiling systems do hide the overlying pipes and supports and create a presentable ceiling; but, at best they can be described as bland and without character. In industrial settings, these types of ceilings are acceptable; but, there is a significant need for ceilings which are aesthetically pleasing with "character".

To this end, a wide variety of naturally occurring materials have been incorporated into ceilings to give them character. In the Southwest United States a wooden beam, being a half log is used as a support member. This beam member, named a Viga, is used to support other wooden members such as small round timbers of about two inches in diameter named latillas, or, the wooden ribs from the saguaro cactus.

Rooms constructed using these types of materials, convey a warm and inviting atmosphere. However, these rooms are extremely expensive to build due to the cost of the natural materials, and due to the fact that the ceilings must be built at the time of the room's construction.

Unfortunately, due to excessive demands for the base materials, their supply has become restricted and in some instances laws have been enacted to prevent the harvesting of these materials so that the supplying species can survive (i.e. saguaros).

It is clear from the foregoing that the present ceiling systems do not address the needs of the industry.

SUMMARY OF THE INVENTION

The invention involves an improved ceiling system which is to be assembled under an existing ceiling. The ceiling system is constructed of materials so as to simulate naturally occurring materials. The support members simulate such items as logs, wooden beams, and the like. Panels between the support member also simulate naturally occurring items like latillas, saguaro ribs, and rough sawn planking.

In the preferred embodiment, the support beams are constructed through a casting method and are composed of foam which is then painted to simulate the desired naturally occurring material. In the preferred embodiment of the panels, they are constructed of the same materials so that the resulting assemblage is not only extremely light and easy to install and transport, but, is also less expensive than naturally occurring materials which are becoming scarce.

In the preferred embodiment, artificial round log beams and artificial saguaro rib ceiling panels combine to provide a realistic and lightweight architectural interior or exterior finish, giving a Southwestern rustic appearance to ceilings. Being artificial in construction, the beams and panels do not deplete the natural environment and they are light enough to be a retro-fit into a room which has been fully constructed.

Because of the retro-fit characteristics of this invention, a room which was originally constructed years earlier, can be redefined to give the sense and feel of the Southwest without requiring the traditional reconstruction of the room.

Although the discussion herein relates to artificial vigas with artificial saguaro rib panels, those of ordinary skill in the art readily recognize that the present invention is also useful for other materials such as oak limbs, mesquite poles, and others. Even a ceiling of slate or fossilized rock planes is included within this discussion.

As noted before, the purpose of the invention is to provide a lightweight alternative to actual round log vigas for new and existing construction projects, without requiring additional structural support. The present Viga system is also well suited to rehabilitation projects due to its ease of installation. In the preferred embodiment, all components are lightweight enough to be handled by one person. However, the installation is made easier if two people perform the task.

The Vigas are a molded and cast using, when dried, a rigid urethane foam, reinforced with plastic or paper tube. Each Viga has such a cross sectional profile, allowing the edges of the ceiling panels to lie on a ledge or shelf formed on either side of the Viga. Once the saguaro rib panel is placed on the Viga, a completed Viga-Saguaro rib ceiling effect is established.

The preferred process of manufacturing the Vigas is a casting technique, which begins by coating the clean surface of the latex or silicone rubber mold with a spray urethane coating, 10–15 mils thick. The rubber mold is then sealed inside the glass fiber reinforced polyester (FRP) "jacket", which hold the mold rigid during the casting process. The reinforcing tube of plastic or paper is placed into the mold prior to sealing the mold jacket.

The reinforcing tube is used in one embodiment of the invention for the conveyance of electrical lines (similar to a conduit) either between the two ends of the Viga or to an electrical connector box located in the Viga itself. This embodiment permits lights to be placed easily within the room.

The FRP jacket sections are clamped or bolted together, forming a completely sealed container. At one end of the Viga mold, a "pour" hole is located and used to fill the empty mold with the liquid foam components. The pour hole is elevated to allow gravity to assist in the uniform filling of the mold with the liquid foam. After the mold is filled with the liquid foam, a plug is inserted into the pour hole.

The two parts of the liquid foam material react with each other, forming millions of tiny gas bubbles encapsulated by the urethane plastic, which hardens quickly, creating the rigid foam.

After the foam has cured, the Viga is de-molded and washed clean to remove the release agent used to coat the mold, prior to adding the urethane layer. When the Viga is thoroughly clean and dry, it is painted in a realistic manner using an actual log viga for reference.

The Saguaro rib panels are molded and cast from the same material as the Vigas, in much the same process, that is, a rubber mold in a rigid jacket, tightly sealed and filled with liquid chemicals which harden into a rigid foam product. The urethane product provides a good transfer of the pattern from mold to part, and yields a superior surface for painting. An assemblage of real Saguaro ribs is used by a skilled artisan for reference when painting the foam parts.

Installation of the Saguaro rib ceiling panels is accomplished by inserting either "butt end" into the cavity formed on each side of the Viga, making sure the decorative face of the panel is face down, until the rib panel touches the "tongue" of the Viga. Then, swing the opposite butt end of the panel upward to a point above the ceiling panel ledge on the adjacent Viga, and slide the ceiling panel toward the tongue of the second Viga without going so far as to remove the first butt end from the panel ledge. The panels will lie on the Viga ledges centered between them in such a way as to allow equal overlap of the panel on both Viga ledges/shelf.

In one embodiment of the invention, the panels are screwed into the beam so it will not move during routine cleaning.

In one embodiment of the invention, both sides of the panel are decorated to simulate a naturally occurring material. Since each side is different, it is up to the installer or the home-owner to select which affect they want, permitting the easy change from one affect to another without having to perform any construction on the room.

The invention, together with various embodiments thereof will be more fully explained by the accompanying drawings and the following descriptions.

DRAWINGS IN BRIEF

DRAWINGS IN DETAIL

Figure 1:
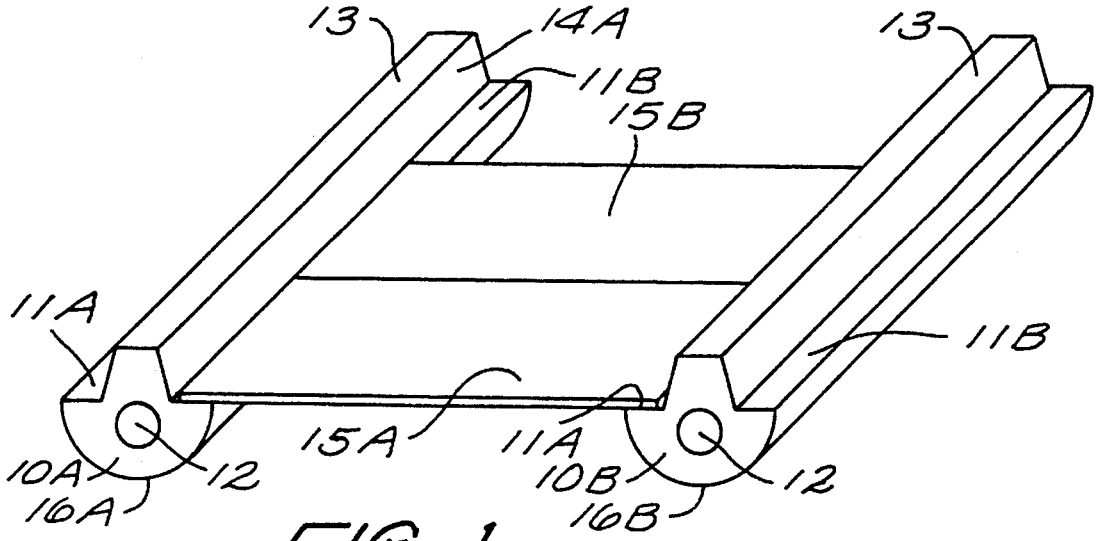
FIG. 1 is a perspective view of the preferred embodiment's interaction between the beam and the panel.

FIG. 1 is a perspective view of the preferred embodiment's interaction between the beam and the panel.

In this illustration, beams 10A and 10B are structured substantially identically. Each beam 10A and 10B have a lower curved surface 16A and 16B respectively which is textured and painted to simulate a naturally occurring material such as a log or the like. Those of ordinary skill in the art readily recognize various techniques to create this simulation.

Two shelves, 11A and 11B are created on the sides of the beam to support the panel 15A and 15B. Tongue member 13 is used to attach the beam to the existing ceiling. In one embodiment of the invention, attachment of tongue member 13 is through the use of adhesives placed on the upper surface of tongue 13. Face 14A extends from the top of tongue 13 to shelf 11B.

A reinforcing member 12 extends the length of beam 16A and supplies more rigidity to the beam 16A. In the preferred embodiment, reinforcing member is constructed of a hollow polyvinylchloride pipe or cardboard tube.

Once the beams 16A and 16B have been attached to the existing ceiling, not shown, panels 15A and 15B are slipped into place to rest onto the appropriate shelf member of the beam 10A and 10B. In one embodiment of the invention, panels 15A and 15B are secured to the shelf member through the use of screw fasteners.

In the preferred embodiment, the entire assemblage is composed substantially of a foam material which is extremely light weight. This permits the artificial ceiling to be attached without concern as to the existing ceiling's ability to support the artificial ceiling.

This embodiment shows the ends of beams 10A and 10B to be unfinished. In this case, the beams 10A and 10B extend from one wall of the room to an opposing second wall. Another embodiment of the invention provides for finished ends to the beams permitting the beams to be "free standing" and not pressed into contact with a wall. In either case, the preferred arrangement is to keep the beams substantially parallel to each other.

Figure 2:
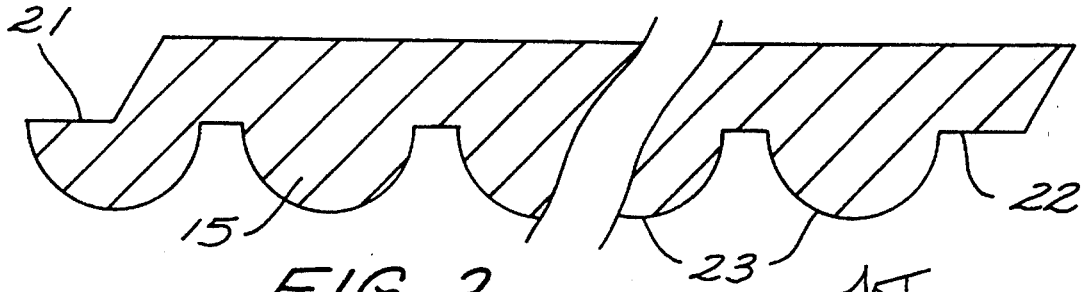
FIG. 2 is a side view of an embodiment of the panel.

FIG. 2 is a side view of an embodiment of the panel.

In the preferred embodiment, the panel is constructed through a casting method and is composed of foam which is then painted to simulate the desired naturally occurring material. The resulting panel is not only extremely light and easy to install and transport, but, is also less expensive than naturally occurring materials.

The preferred process of manufacturing panel 15 is a casting technique, which begins by coating the clean surface of the latex or silicone rubber mold with a spray urethane, 10–15 mils thick. The rubber mold is sealed inside the glass fiber reinforced polyester (FRP) "jacket", which hold the mold rigid during the casting process.

The FRP jacket sections are clamped or bolted together, forming a completely sealed container. At one end of the mold, a "pour" hole is located and used to fill the empty mold with the liquid foam components. The pour hole is elevated to allow gravity to assist in the uniform filling of the mold with the liquid foam. After the mold is filled with the liquid foam, a plug is inserted into the pour hole.

The two parts of the liquid foam material react with each other, forming millions of tiny gas bubbles encapsulated by the urethane plastic, which hardens quickly, creating the rigid foam.

After the foam has cured, the panel is de-molded and washed clean to remove the release agent used to coat the mold, prior to adding the urethane layer. When the panel is thoroughly clean and dry, it is painted in a realistic manner using an actual log viga for reference.

The sides of the panel 15 are constructed of mating extensions 21 and 22 so that adjoining panels are "locked" together with an invisible seam making the joints invisible.

Surface 23, in this embodiment, is structured to simulate saguaro ribs which have been placed in close proximity.

Surface 23 is painted to further this simulation.

Figure 3:
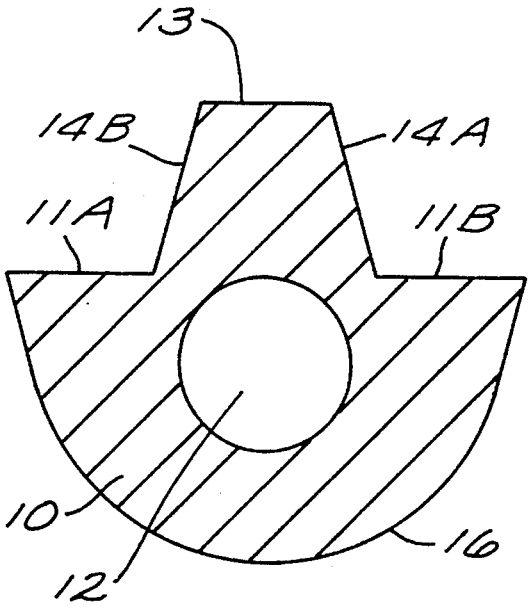
FIG. 3 is a cross-sectional view of an embodiment of the beam.

FIG. 3 is a cross-sectional view of an embodiment of the beam.

As noted earlier, beam 10 is constructed in the same manner as the panels using foam in a mold.

In this embodiment, beam 10 has lower surface 16 is textured and painted to simulate a naturally occurring material. Reinforcing member 12, in this embodiment is a polyvinylchloride or cardboard pipe having a hollow cavity extending its length. The circular shape of reinforcing member 12 is particularly effective in resisting deformation and thereby creates a strong reinforcing member.

The resulting foam beam with hollow reinforcing member is extremely light weight while providing sufficient structural rigidity for the creation of the artificial ceiling of this invention.

Shelf members 11A and 11B extend inward from curved surface 16 and create planes for holding the panel members (not shown in this figure). Face 14A and 14B extend from shelf members 11A and 11B to top surface 13, thereby creating the tongue member. The tongue member is used to secure the beam to an existing ceiling.

Figure 4A:
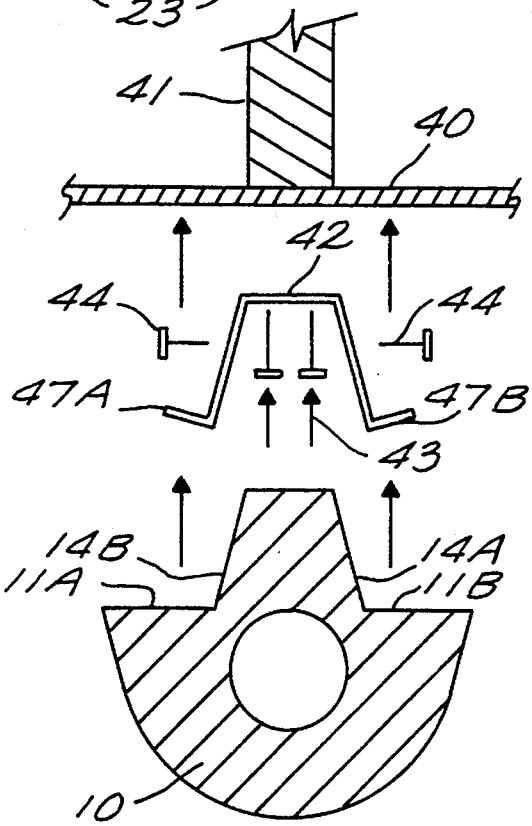
FIGS. 4A and 4B are assembly views of two embodiment's used to secure the beam to the existing ceiling.
Figure 4B:
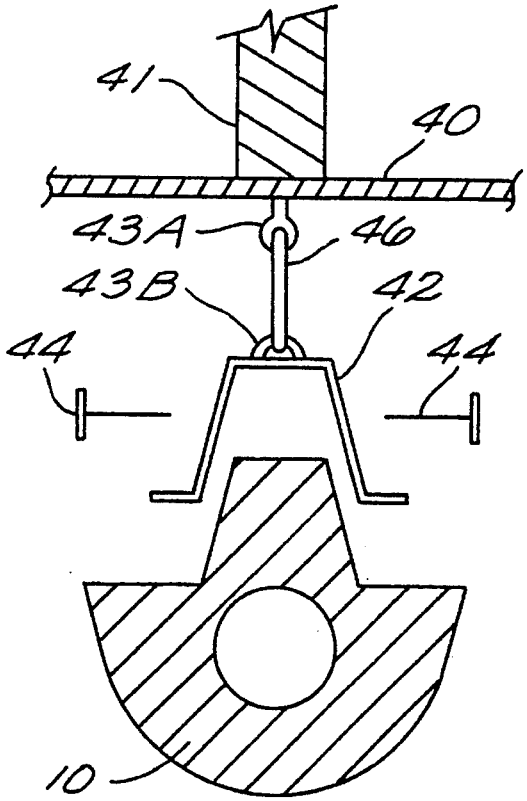

FIGS. 4A and 4B are assembly views of two embodiments used to secure the beam to the existing ceiling.

As shown in FIG. 4A, the existing ceiling is composed of particle board or sheetrock 40 which is secured to beam 41 (other beams are not shown). In this embodiment, bracket 42 is attached to beam 41 through the use of screws 43. Bracket 42, in the preferred embodiment, extends the entire length of the beam; in other embodiments, a series of shorter brackets, in a spaced-apart relationship, are used to provide support for the entire artificial beam 10.

Beam 10 is inserted into bracket 42 permitting side walls 14A and 14B to mate with the sides of bracket 42. Nails or screws 44 are inserted through bracket 42 and into the tongue of artificial beam 10. This secures the artificial beam 10 to the bracket which is secured to beam 41 of the existing ceiling.

Spring clips 47A and 47B extend from bracket 42 and are used to press the panel, not shown in this figure, against shelf member 11A and 11B respectively. These spring clips 47A and 47B are especially useful when other means of securing the panel to the beam are not easily accessible.

FIG. 4B shows an alternative embodiment for mounting artificial beam 10 the ceiling's beam 41. In this embodiment eye ring 45A is secured to bracket 42 by way of cable 46 and ring 45B. This suspension method is useful where pipes and other items attached to the existing ceiling must be avoided.

Again, nails or screws 44 are used to secure the artificial beam 10 to bracket 42.

Figure 5:
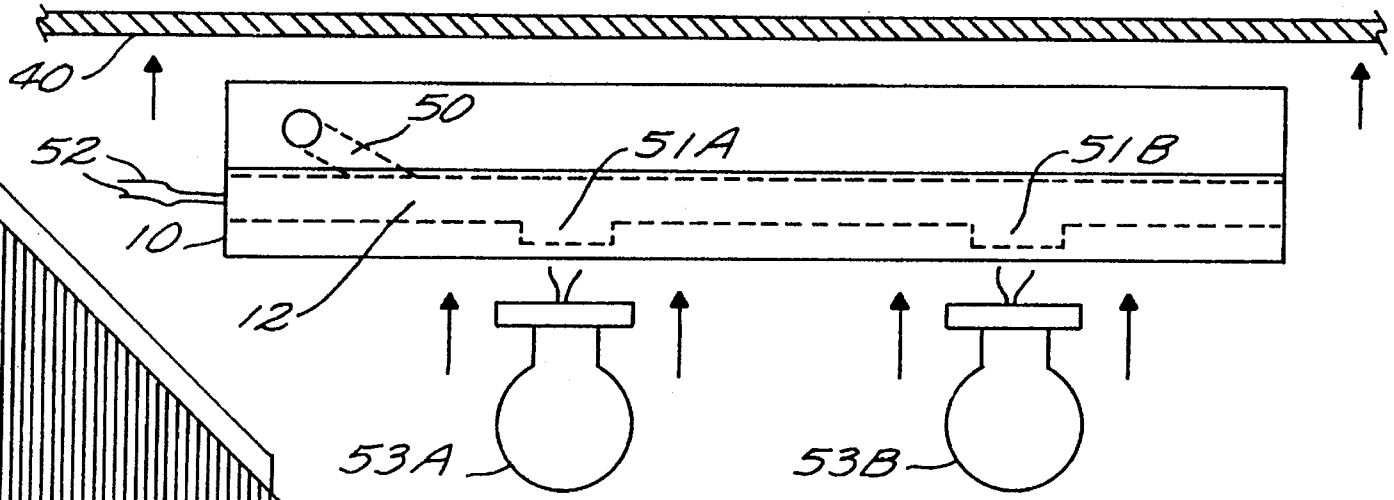
FIG. 5 is a side view illustrating the preferred embodiments use of the reinforcing member for an electrical conduit.

FIG. 5 is a side view illustrating the preferred embodiments use of the reinforcing member for an electrical conduit.

Artificial beam 10 is to be secured to ceiling beam 40. Running the length of artificial beam 10 is reinforcing member 12 which is a hollow pipe communicating with electrical connectors 51A and 51B. In this embodiment, electrical connectors 51A and 51B are totally contained within artificial beam 10 and are located at selected points along the artificial beam 10. In use, when the contractor wants to install light fixtures 53A and 53B, the overlying foam hiding the electrical connector is removed using a saw or hammer/chisel combination. Other embodiments of artificial beam 10 have the electrical connectors exposed so that foam removal is not required.

External electricity is communicated via wires 52 which extend through the reinforcing member 12 to the electrical connectors 51A and 51B.

In an alternative embodiment, channel 50 has an opening in the tongue portion of the artificial beam 10 permitting wires to be fed therethrough to the electrical connectors 51A and 51B.

The use of the electrical connectors within the beam permit easy inclusion of lights or fans into the ceiling arrangement.

Figure 6:
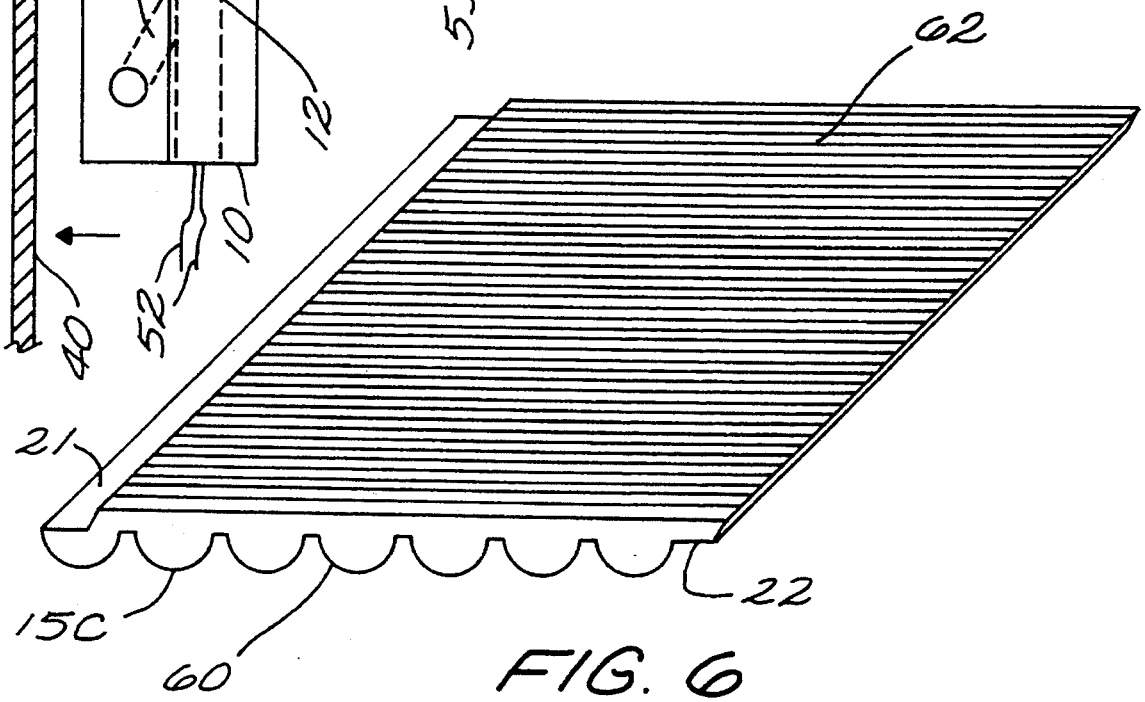
FIG. 6 is a perspective view of the preferred embodiment of the invention in which both sides of the panel simulate differing materials.

FIG. 6 is a perspective view of the preferred embodiment of the invention in which both sides of the panel simulate differing materials.

Panel 15C is substantially a flat member having two surfaces. In one embodiment of the invention, each surface is arranged to simulate different naturally occurring materials. As example, surface 60 simulates saguaro ribs while surface 62 simulates latillas.

This arrangement is particularly useful in that it permits the homeowner to change the panel's affect on the room's "feel" by simply flipping the panel over to expose the other side.

In this manner, the invention creates a highly versatile artificial ceiling arrangement which eliminates the need to have the ceiling defined during initial construction of the room.

What is claimed is:

1. An improved artificial ceiling system to be assembled onto an existing ceiling located between multiple walls, said artificial ceiling system comprising:

a) At least two support members, each support member attached to said existing ceiling and extending from one wall member to a second opposing wall member such that said support members are substantially parallel, each of said support members having, 1) a curved lower surface extending the length of said support member and being surfaced to simulate an exterior surface of a log, 2) a first and a second shelf member extending the length of said support member, each of said shelf members extending a predetermined distance in from said curved lower surface, and, 3) a tongue member extending the length of said support member and contacting both of said shelf members and extending upward from a plane of said shelf members, said tongue member having at least one flat surface for securement of said support member to said existing ceiling along the entirety of said tongue member; and, b) a multiplicity of artificial panel members, each of said artificial panel members extending between two of said support members and supported solely by the shelf member of said support members, each of said artificial panel members having a first surface constructed to simulate a naturally occurring material, said first surface positioned to face downward.

2. The improved artificial ceiling system according to claim 1 wherein said panel members are substantially rectangular and wherein a first edge of said panel member and an opposing second edge are shaped to mate with neighboring panel members.

3. The improved artificial ceiling system according to claim 2 wherein the first surface of each of said panel members simulates a first naturally occurring material and a second surface of each of said panel members simulates a different second naturally occurring material.

4. The improved artificial ceiling system according to claim 3 wherein said first naturally occurring material includes saguaro ribs.

5. The improved artificial ceiling system according to claim 4 wherein said second naturally occurring material includes latillas.

6. The improved artificial ceiling system according to claim 2 further including means for attaching each of said panel members to said support members.

7. The improved artificial ceiling system according to claim 1 wherein each of said support members includes a reinforcing member extending the length of said support member, said reinforcing member being contained within said support member.

8. The improved artificial ceiling system according to 7 wherein said reinforcing member has a substantially round cross-section and is hollow.

9. The improved artificial ceiling system according to claim 8 wherein said support members include electrical connectors contained within said support member and located at selected positions along said support member, each of said electrical connectors communicating with said reinforcing member.

10. The improved artificial ceiling system according to claim 9 further including electrical wires extending from one end of said support member through said reinforcing member to said electrical connectors.

11. The improved artificial ceiling system according to claim 1 further including a plurality of attachment brackets, each of said attachment brackets being secured to said existing ceiling and secured to said tongue member.

12. The improved artificial ceiling system according to claim 11 wherein each of said tongue members includes a first and a second upright face extending from said shelf member and wherein said bracket member attaches to said first and second upright faces.

13. The improved artificial ceiling system according to claim 12 wherein said bracket includes spring means for pressing an edge of said panel member against said shelf member.

14. A simulated material ceiling system to be assembled onto an existing ceiling, said artificial ceiling system comprising:

a) At least two support members, each support member attached to said existing ceiling such that said support members are substantially parallel, each of said support members having, 1) a lower surface extending the length of said support member and being surfaced to simulate an exterior surface of a naturally occurring article, 2) a first and a second shelf member extending the length of said support member, and, 3) a tongue member extending the length of said support member and having at least one surface for securement of said support member to said existing ceiling; and, b) a multiplicity of artificial panel members, each of said artificial panel members extending between two of said support members and supported solely by the shelf member of said support members, each of said artificial panel members having a first surface constructed to simulate a naturally occurring material, said first surface positioned to face downward.

15. The simulated material ceiling system according to claim 14 wherein said panel members are substantially rectangular and wherein a first edge of said panel member and an opposing second edge are shaped to mate with neighboring panel members.

16. The simulated material ceiling system according to claim 15 wherein the first surface of each of said panel members simulates a first naturally occurring material and a second surface of each of said panel members simulates a different second naturally occurring material.

17. The simulated material ceiling system according to claim 16 wherein said first naturally occurring material includes saguaro ribs.

18. The simulated material ceiling system according to claim 17 wherein said second naturally occurring material includes latillas.

19. The simulated material ceiling system according to claim 15 further including means for attaching each of said panel members to said support members.

20. The simulated material ceiling system according to claim 14 wherein each of said support members includes a reinforcing member extending the length of said support member and is totally contained within said support member.

21. The simulated material ceiling system according to 20 wherein said reinforcing member has a substantially round cross-section and is hollow.

22. A ceiling panel to be suspended under an existing ceiling comprising a first surface constructed to simulate a naturally occurring material, said first surface positioned to face downward, said ceiling panel to be supported solely at two opposing edges thereof.

23. The simulated material ceiling system according to claim 22 further including electrical wires extending through a portion of said reinforcing member to said electrical connectors.

24. The simulated material ceiling system according to claim 14 further including a plurality of attachment brackets, each of said attachment brackets being secured to said existing ceiling and secured to said tongue member.

25. The simulated material ceiling system according to claim 24 wherein each of said tongue members includes a first and a second upright face extending from said shelf member and wherein said bracket member attaches to said first and second upright faces.

26. The simulated material ceiling system according to claim 25 wherein said bracket includes spring means for pressing an edge of said panel member against said shelf member.

* * * * *